US006540330B1

(12) United States Patent
Kubota et al.

(10) Patent No.: US 6,540,330 B1
(45) Date of Patent: Apr. 1, 2003

(54) LIQUID DISCHARGE HEAD, METHOD FOR PRODUCING THE SAME AND LIQUID DISCHARGE APPARATUS

(75) Inventors: Masahiko Kubota, Tokyo (JP); Koromo Shirota, Kawasaki (JP); Teruo Ozaki, Yokohama (JP); Ryuji Katsuragi, Tokyo (JP); Hidehiko Kanda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/670,882

(22) Filed: Sep. 27, 2000

(30) Foreign Application Priority Data

Oct. 5, 1999 (JP) ..... 11-284948

(51) Int. Cl.[7] ..... B41J 2/135
(52) U.S. Cl. ..... 347/45
(58) Field of Search ..... 347/45

(56) References Cited

U.S. PATENT DOCUMENTS

| | | | | |
|---|---|---|---|---|
| 5,479,197 A | | 12/1995 | Fujikawa et al. | 347/63 |
| 5,633,664 A | | 5/1997 | Bayat | 347/47 |
| 5,751,313 A | | 5/1998 | Miyashita et al. | 347/45 |
| 5,805,180 A | | 9/1998 | Ebisawa et al. | 347/23 |
| 6,079,809 A | | 6/2000 | Yaegashi et al. | 347/35 |
| 6,095,640 A | | 8/2000 | Ishinaga et al. | 347/65 |
| 6,130,692 A | | 10/2000 | Mochizuki et al. | 347/57 |
| 6,312,103 B1 | * | 11/2001 | Haluzak | 347/45 |

FOREIGN PATENT DOCUMENTS

| | | |
|---|---|---|
| EP | 0 864 428 A2 | 9/1998 |
| WO | WO 96/35584 | 11/1996 |

OTHER PUBLICATIONS

Patent Abstracts of Japan, vol. 012, No. 325 (M–737), Sep. 5, 1988 (JP 63–092455 A, Apr. 22, 1988).
Patent Abstracts of Japan, vol. 006, No. 083 (M–130), May 21, 1982 (JP 57–022063 A, Feb. 4, 1982).
Patent Abstracts of Japan, vol. 006, No. 029 (M–113), Feb. 20, 1982 (JP 56–146761 A, Nov. 14, 1981).

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

A liquid discharge head provided with a pair of substrates mutually adjoined in a laminar state, plural liquid flow paths formed on the adjoined surface of said substrates, plural drive elements respectively formed in a predetermined position of said liquid flow paths, and orifices communicating with ends of said liquid flow paths in which liquid discharged from said orifice by the action of said drive element, wherein a face constituting an external surface of a member forming said orifices is coated with a material with super-hydrophilicity.

21 Claims, 9 Drawing Sheets

LIQUID DISCHARGE HEAD, METHOD FOR PRODUCING THE SAME AND LIQUID DISCHARGE APPARATUS

BACKGROUND OF THE INVENTION

1. Field of the Invention

The present invention relates to a liquid discharge head and a liquid discharge apparatus adapted for use in a printer or a video printer as an output terminal of a copying apparatus, a facsimile apparatus, a word processor, a host computer or the like, and more particularly to a liquid discharge head and a liquid discharge apparatus having a substrate on which formed is an electrothermal converting element (heat generating element) for generating thermal energy to be utilized as energy for recording. More specifically, it relates to a liquid discharge head for use in a liquid discharge apparatus for executing recording by discharging recording liquid (ink etc.) as a flying droplet from a discharge port (orifice) and depositing such droplet onto a recording medium.

The present invention also relates to a cleaning member for removing deposit on a discharge port face of a liquid discharge head for executing recording by discharging ink, and a liquid discharge apparatus provided with such cleaning member.

2. Related Background Art

Developments and improvements are being made on the liquid discharge apparatus, particularly the ink jet recording apparatus, because such apparatus is strongly desired as a non-impact recording technology in the current business office and other office environment in which noises are undesirable, and also because such apparatus is capable of high-density recording with a high speed and can be constructed relative free of maintenance or maintenance-free.

Among such ink jet recording apparatus, that as disclosed in the Japanese Patent Application Laid-Open No. 54-59936 is strongly desired for commercialization since it is sufficiently capable of high-density recording at a high speed and it easily enables designing and manufacture of so-called full-line liquid discharge head because of its features in the configuration.

Also in the ink jet system, color recording can be easily achieved and the apparatus can be realized compact as the semiconductor technology can be utilized in manufacturing the liquid discharge head.

In such ink jet system, there is employed a liquid discharge head provided with plural ink discharge ports of a very small diameter. In the recording operation, ink is discharged from such ink discharge ports according to the input of predetermined recording signals and is deposited on a recording medium.

The recording apparatus utilizing such liquid discharge head may be associated with the following drawbacks. In an ink jet recording apparatus for discharging ink which is formed as a particle in the discharge port of a small diameter, dusts present in the apparatus, paper dusts from the recording medium or ink droplets may be deposited or solidified, as shown in FIG. 7, on the face having the discharge ports (hereinafter represented also as port face or orifice face) or in the vicinity of the discharge port (hereinafter represented also as orifice). Such deposit may render unstable the flying path of the ink particle discharged from the discharge port, or may be solidified by drying to clog the discharge port, thereby rendering the ink discharge impossible.

Such phenomena result from a fact that the orifice face of the liquid discharge head is more or less ink repellent, whereby ink droplets are present in dispersed manner on such face and are therefore dried and solidified. It has been feared that these phenomena hinder full exploitation of the excellent features of the ink jet system.

SUMMARY OF THE INVENTION

A principal object of the present invention is to provide a liquid discharge head allowing prolonged use in case high reliability is required in a full-color recording apparatus or a high-speed recording apparatus, and a liquid discharge recording apparatus utilizing such liquid discharge head.

The foregoing object can be attained, according to the present invention, by a liquid discharge head comprising a pair of substrates mutually adhered in a laminated state, plural liquid flow paths formed on the adhered face of the substrates, plural drive elements formed in a predetermined position in respective liquid flow paths, and orifices communicating with the ends of the liquid flow paths, in which the liquid is discharged from the orifice by the function of the drive element, wherein a face constituting the external surface of a member forming the orifices is coated with a material with superhydrophilicity.

In the present invention, the aforementioned drive element is a heat generating element which generates thermal energy, and there is provided a liquid discharge head in which the heat generating element causes the liquid in the liquid flow path to boil thereby generating a bubble in the liquid and the liquid discharged from the orifice by a pressure generated at the generation of the bubble.

According to the present invention, there is provided a liquid discharge head comprising a discharge port for discharging liquid, a liquid flow path communicating with the discharge port, a heat generating element formed in a predetermined position on the liquid flow path, and a supply aperture for supplying the liquid flow path with the liquid, in which the heat generating element causes the liquid in the liquid flow path to boil thereby generating a bubble and the liquid is discharged from the discharge port by a pressure generated at the generation of the bubble, wherein a face constituting the external surface of a member forming the orifices is coated with a material with superhydrophilicity.

In the present invention, the contact angle between the aforementioned material with superhydrophilicity and the liquid can be 5° or less. Also there is provided a liquid discharge apparatus provided with the aforementioned liquid discharge head. Also there is provided a liquid discharge head including the aforementioned liquid discharge head and a cleaning member for removing the stain deposited on the face constituting the external surface of the orifice forming member without contacting such face.

In the present invention, there may be provided an ultraviolet light source for maintaining the superhydrophilicity of the aforementioned face over a prolonged period. Otherwise there may be provided an aperture for introducing, from the exterior, ultraviolet light for maintaining the superhydrophilicity of the aforementioned face over a prolonged period.

According to the present invention, there is provided a method for producing a liquid discharge head, comprising a step of forming plural drive elements on a surface of at least one of substrates, a step of forming plural liquid flow paths so as to respectively correspond to the drive elements, a step of adjoining the substrates in such a laminated state that the surface bearing the liquid flow paths constitutes the adjoined surface, a step of forming a member for forming orifices at an end of the adjoined substrates, a step of coating the face constituting the external surface of the aforementioned member with a material with super hydrophilicity, and a step of causing the orifices to communicate with the respective liquid flow paths.

According to the present invention, there is provided a method for producing a liquid discharge head comprising a step of forming an element substrate consisting of silicon on a surface of at least one of substrates, a step of forming plural heat generating elements for generating thermal energy on the element substrate, a step of forming plural liquid flow paths so as to respectively correspond to the heat generating elements, a step of adjoining the substrates in such a laminated state that the surface bearing the liquid flow paths constitutes the adjoined surface, a step of forming a member for forming orifices at an end of the adjoined substrates, a step of coating the face constituting the external surface of the aforementioned member with a material with superhydrophilicity, and a step of causing the orifices to communicate with the respective liquid flow paths.

According to the present invention, there is provided a method for producing a liquid discharge head comprising a step of forming a heat generating element for generating thermal energy on an element substrate consisting of silicon, a step of forming a liquid flow path corresponding to the heat generating element, a step of forming a supply aperture for supplying the liquid flow path with liquid, a step of forming a member for forming an orifice for discharging the liquid, a step of coating the member with a superhydrophilic material, and a step of forming an orifice in the coated member.

The material with superhydrophilicity means such a material that liquid deposited thereon does not form a liquid drop but forms a substantially zero contact angle with such material. The contact angle is measured for example by a contact angle meter CA-X150 manufactured by Kyowa Kaimen Kagaku Co., Ltd. and can be defined preferably not exceeding 5° and more preferably not exceeding 4°. The characteristics of the face can be further improved if the contact angle is within the above-mentioned range.

In the present invention, as the face is coated with the material with superhydrophilicity, the smear induced by the liquid deposited on such face does not form a liquid drop but is spread as a thin film over the entire face, whereby formation of a particle by drying can be prevented. Consequently, there can be prevented clogging of the orifice or the discharge port by the particle induced by smear, and the liquid discharge head of the present invention can maintain satisfactory performance over a prolonged period.

Examples of the member for removing the smear deposited on the face without contact therewith include an air nozzle or a water nozzle provided in the vicinity of the discharge port for the liquid. Such member blows off the smear floating on the face, thereby effectively removing the smear without contacting the face.

DESCRIPTION OF THE PREFERRED EMBODIMENTS

The present invention will be clarified in detail by preferred embodiment thereof, but the present invention is by no means limited by such embodiments. The present invention in the following embodiments allows to further effectively exploit the excellent characteristics of the ink jet recording method.

Figure 1:
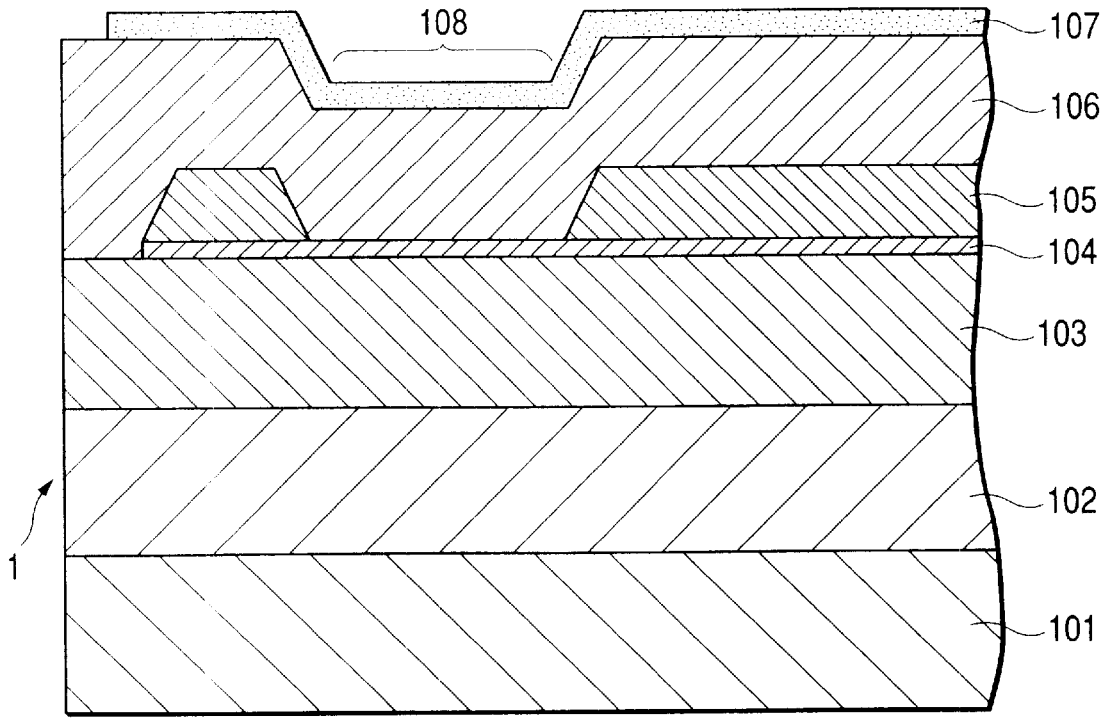
FIG. 1 is a cross-sectional view of a portion corresponding to an ink flow path in the present invention.

FIG. 1 is a cross-sectional view of a portion corresponding to an ink flow path on a substrate for the liquid discharge head of the present invention. In FIG. 1, there are shown a silicon substrate 101, a thermal oxidation film 102 constituting a heat accumulating layer, an $SiO_2$ or $Si_3N_4$ interlayer serving also as a heat accumulating layer, a resistance layer 104 for generating thermal energy, an Al alloy wiring composed for example of al, Al—Si or Al—Cu, an $SiO_2$ or $Si_3N_4$ protective film 106, an anticavitation film 107 for protecting the protective film 106 from chemical and physical impact resulting from heat generation by the resistance layer 104, and a heat action portion 108 of the resistance layer 104 in an area thereof not provided with the electrode wiring 105.

These drive elements are formed in an Si substrate by semiconductor technology and the heat action portion is further formed on the same substrate. In the present embodiment the drive element is composed of a heat generating element, but there can also be employed a drive element for discharging liquid by the electric, magnetic or vibrational function.

Figure 2:
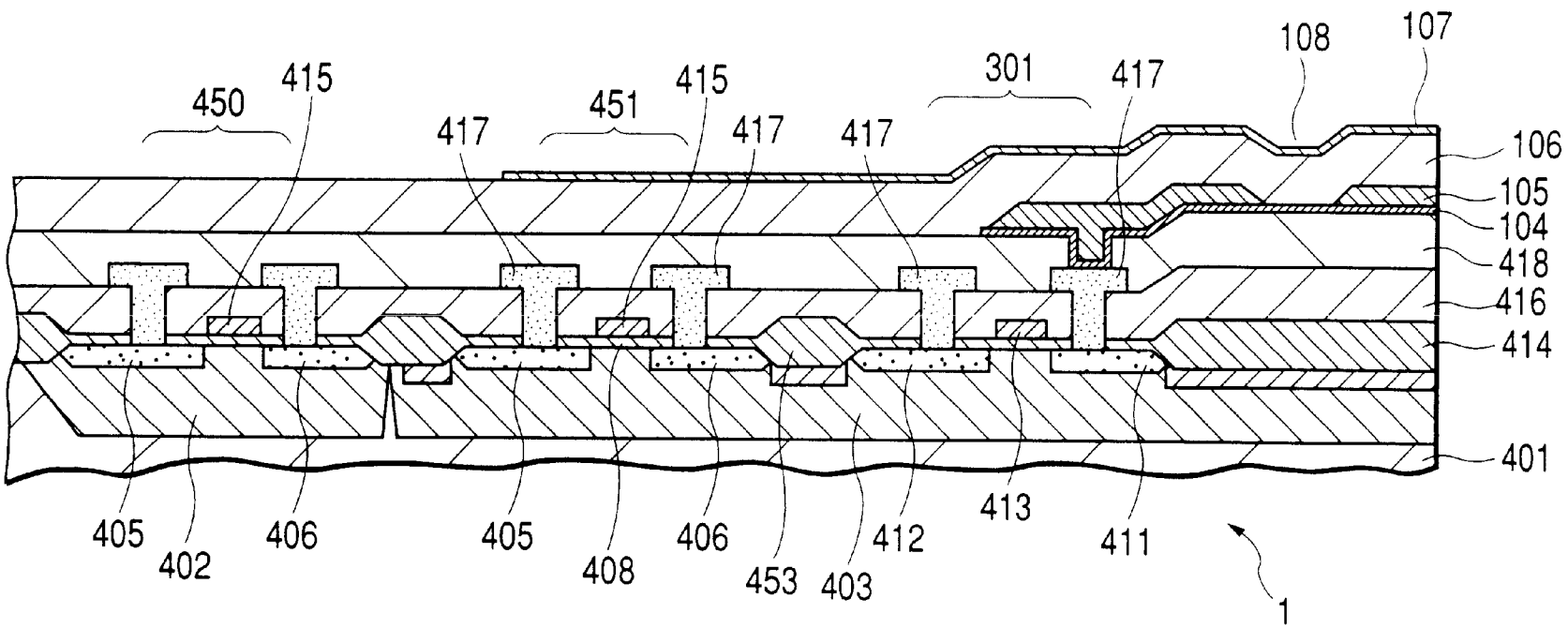
FIG. 2 is a schematic cross-sectional view of a heat generating element in the present invention.

FIG. 2 is a schematic cross-sectional view showing the longitudinal cross section of the heat generating element. An ordinary MOS process such as impurity introduction for example by ion implantation and diffusion is used on a P-type Si substrate 401 to form a P-MOS transistor 450 in an N-type will area 402 and an N-MOS transistor 451 in a P-type well area 405. Each of the P-MOS transistor 450 and the N-MOS transistor 451 is composed of a polysilicon gate wiring 415 deposited by CVD with a thickness from 4000 to 5000 Å across a gate insulation film 408 of several hundred Angstroms, a source area 405 and a drain area 406 formed by N- or P-impurity introduction, and such P-MOS transistor and N-MOS transistor constitute a C-MOS logic.

Also an N-MOS transistor for driving the element is composed of a drain area 411, a source area 412 and a gate wiring 413 formed in a P-well by steps of impurity introduction, diffusion etc. The present embodiment is explained by a configuration employing N-MOS transistor, but there may be adopted any transistor capable of individually driving plural heat generating elements and attaining a fine structure as explained in the foregoing.

The elements are mutually isolated by an oxidation film separation area 453 formed by field oxidation with a thickness of 5000 to 10000 Å. Under the heat action portion 108, this field oxidation film functions as a first heat accumulation layer 414.

After the formation of the elements, an interlayer insulation film 416 composed for example of PSG or BPSG is deposited by CVD with a thickness of about 7000 Å, and, after thermal flattening, wiring is formed by an Al electrode 417 constituting a first wiring layer, through a contact hole. Then an interlayer insulation film 418 composed for example of an $SiO_2$ film is deposited by plasma CVD with a thickness of 10000 to 15000 Å, and a resistance layer 104 composed of a $TaN_{0.8.hex}$ film of a thickness of about 1000 Å is formed through a throughhole by DC sputtering. Then a second Al electrode wiring constituting the wiring to each heat generating member is formed. Then a protective film 106 composed of an $Si_3N_4$ film is formed with a thickness of about 10000 Å by plasma CVD. In the uppermost part, an anticavitation film 107 composed of an amorphous metal containing Ta is deposited with a thickness of about 2500 Å.

Figure 3:
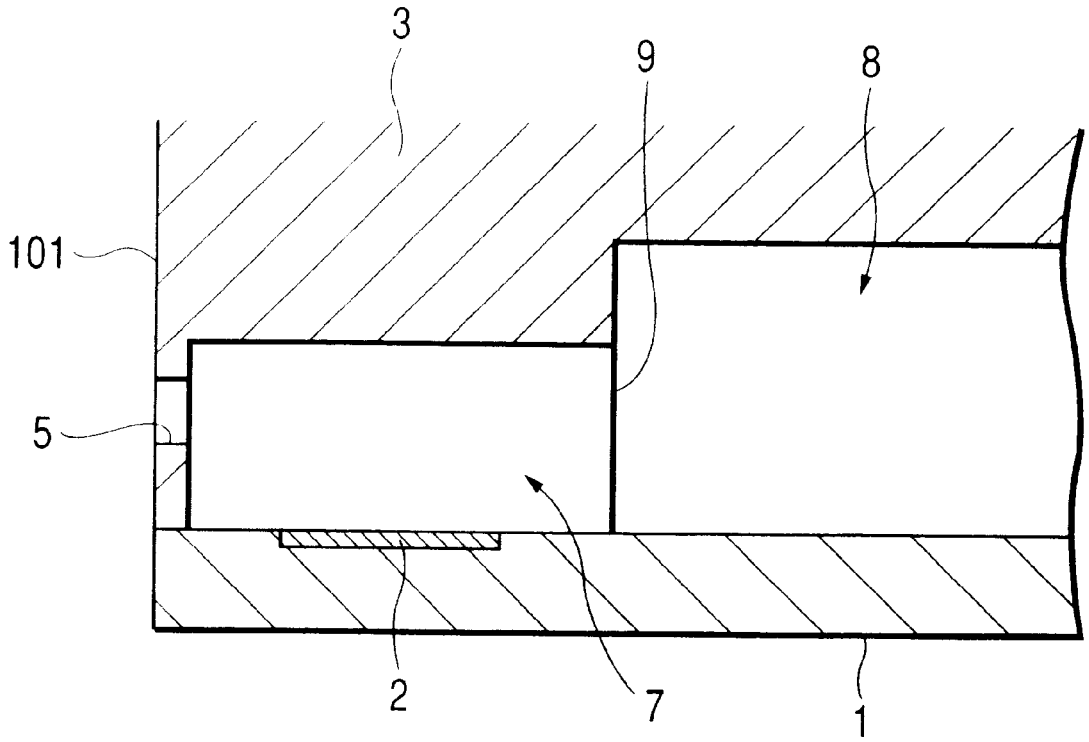
FIG. 3 is a cross-sectional view of a liquid discharge head of the present invention, along the direction of liquid flow path.

FIG. 3 is a cross-sectional view of the liquid discharge head of the present invention along the direction of the liquid flow path.

Figure 4A:
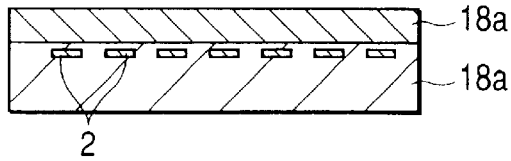
FIGS. 4A, 4B, 4C, 4D, 4E and 4F are views showing an example of steps of the manufacturing process for the liquid discharge head of the present invention.
Figure 4B:
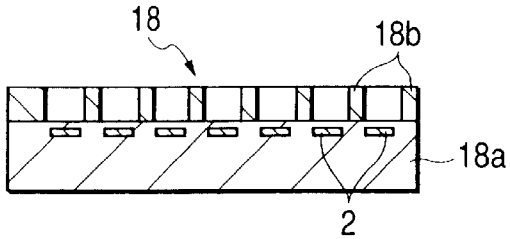
Figure 4C:
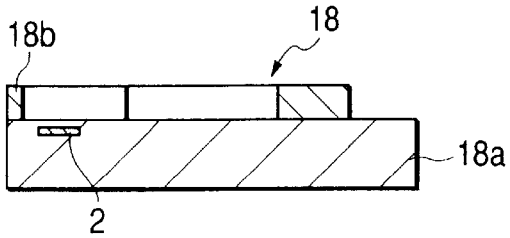
Figure 4D:
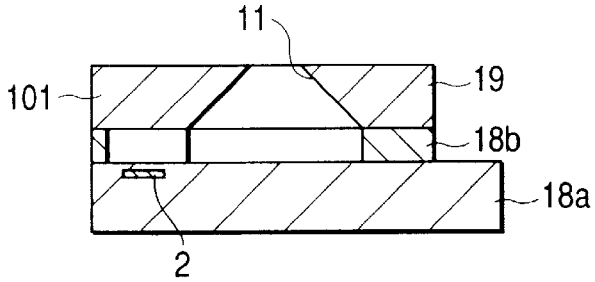

FIGS. 4A to 4F are views showing the flow of manufacturing process for the liquid discharge head. In FIG. 4A, after forming a thermal oxidation $SiO_2$ film with a thickness of about 1 $\mu$m on both surfaces of a silicon wafer, a portion constituting a common liquid chamber is patterned by a known method such as a photolithographic process, and an SiN film constituting a nozzle member is formed with a thickness of about 20 $\mu$m by $\mu$W-CVD. Monosilane ($SiH_4$), nitrogen ($N_2$) and argon (Ar) are used as gasses for $\mu$W-CVD for forming the SiN film. There may be also employed a gaseous mixture containing disilane ($Si_2H_6$) or ammonia ($NH_3$). In the present embodiment, the SiN film was formed in high vacuum of 5 mTorr, employing microwave (2.45 GHz) of a power of 1.5 kW and a gas flow rate of $SiH_4/N_2/Ar$=100/100/40 (sccm). The SiN film may also be formed with another gas composition or by RF-CVD. Then the portions constituting the orifice and the liquid flow path are patterned with a known method such as photolithographic process, and a trench structure is etched by an etching apparatus utilizing dielectric-coupled plasma. Then the silicon wafer is subjected to penetrating etching with TMAH to obtain a silicon top plate integral with the orifice.

Then, on the substrate for the liquid discharge head shown in FIG. 1, a portion to be adjoined with the aforementioned orifice-integrated silicon top plate is patterned by a known method such as photolithographic process, and the portions to be adjoined of both members are activated by irradiation with Ar gas etc. in vacuum and are adjoined at normal temperature. The normal temperature adjoining apparatus employed in this operation was composed of two vacuum chambers, namely a preparatory chamber and a pressure contact chamber, maintained at vacuum of 1 to 10 Pa. In the preparatory chamber, the liquid discharging substrate and the orifice-integrated silicon top plate mentioned above are aligned by image processing in order to match the portions to be adjoined. Then the members maintained in this state are transported to the pressure contact chamber and the surface of the SiN film in the portion to be adjoined is irradiated with energy particles by a high speed atomic beam of saddle field type. After the surface is activated by such irradiation, the liquid discharging substrate and the orifice-integrated silicon top plate are mutually adjoined. In this operation, in order to increase the strength of adjoining, there may also be executed heating at 200° C. or lower or pressurization.

Figure 4E:
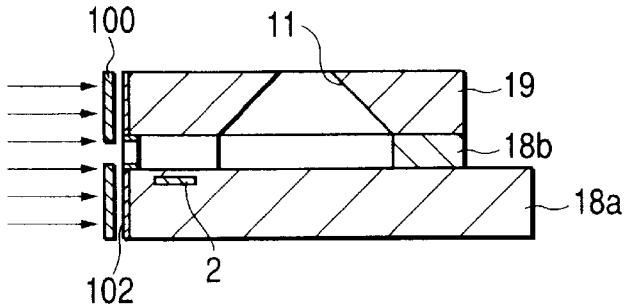

Then, as shown in FIG. 4E, a superhydrophilic film 102 is formed on the orifice face 101. In the following there will be explained an example of coating method with the material having superhydrophilicity in the present invention, but the present invention is not limited by such example.

There can be employed a method of coating the orifice face with amorphous titania ($TiO_2$) and changing the phase of amorphous titania into crystalline titania (anatase type or lutyl type) by sintering. The amorphous titania can be formed by any of the following methods (1) to (3).

(1) Hydrolysis and Dehydration Condensation-Polymerization of Organic Titanium Compound A titanium alkozyde such as tetraethoxy titanium, tetraisopropoxy titanium, tetra-n-propoxy titanium, tetrabutoxy titanium or tetramethoxy titanium is added with a hydrolysis suppressor such as hydrochloric acid or ethylamine, and diluted with alcohol such as ethanol or propanol. Then, while hydrolysis is being partly executed or after hydrolysis is completed, the mixture is coated on a substrate by spray coating, flow coating, spin coating, dip coating or roller coating, and is dried within a temperature range from normal temperature to 200° C. The drying completes hydrolysis of titanium alkoxyde to generate titanium hydroxide and the titanium hydroxide is subjected to dehydration condensation polymerization to form a layer of amorphous titania on the surface of the substrate. Instead of titanium alkoxyde, there may also be employed another organic titanium compound such as titanium chelate or titanium acetate.

(2) Formation of Amorphous Titanium by Inorganic Titanium Compound

Acidic aqueous solution of an inorganic titanium compound such as $TiCl_4$ or $Ti(SO_4)$ is coated on the surface of a substrate by spray coating, flow coating, spin coating, dip coating or roller coating. Then the inorganic titanium compound is subjected to hydrolysis and dehydrating condensation polymerization by drying at about 100° C. to 200° C. to form a layer of amorphous titania on the surface of the substrate. Otherwise amorphous titania may be deposited on the surface of the substrate by chemical evaporation of $TiCl_4$.

(3) Formation of Amorphous Titania by Sputtering

Amorphous titania is formed on the surface of the substrate by irradiating a target of metallic titanium with an electron beam in an oxygen atmosphere.

The amorphous titania formed by either of the aforementioned methods (1) to (3) is sintered at a temperature of 400° C. to 500° C. The sintering at such temperature achieves conversion to anatase titania.

Then the aforementioned superhydrophilic film of anatase type can be photoexcited with ultraviolet light of a wavelength not exceeding 387 nm. The light source of such ultraviolet light can be an indoor illuminating lamp such as a fluorescent lamp, an incandescent lamp, a metal halide lamp or a mercury lamp.

As a specific example, there was prepared coating solution by mixing the following:

| | |
|---|---|
| ethanol | 86 parts by weight |
| tetraethoxy silane | 6 parts by weight |
| hydrochloric acid (36%, aq) | 2 parts by weight |
| pure water | 6 parts by weight |

The above-mentioned solution was spray coated on the orifice face of the aforementioned liquid discharge head and was dried at 80° C. By drying, tetraethoxy silane was hydrolyzed to silanol which was then subjected dehydrating condensation polymerization to form a thin film of amorphous silica on the orifice face. Then coating solution was prepared by mixing:

| | |
|---|---|
| tetraethoxy titanium | 10 parts by weight |
| ethanol | 89 parts by weight |
| hydrochloric acid (36%, aq) | 1 part by weight |

The above-mentioned solution was spray coated on the aforementioned orifice face 101 and was dried at 150° C. As hydrolysis of tetraethoxy titanium is extremely fast, tetraethoxy titanium was partly hydrolyzed to generate titanium hydroxide even in the course of coating. This step formed amorphous titania on amorphous silica.

Then the liquid discharge head was placed in an atmosphere of 400° C. to convert amorphous titania into anatase type titania.

Then, after the liquid discharge head was let to stand for 24 hours in a dark place, the orifice face was irradiated with ultraviolet light for about 1 hour by a 20 W blue light black (BLB) fluorescent lamp (Sankyo Electric Co., FL20BLB) with an ultraviolet intensity of 0.5 $mW/cm^2$ (ultraviolet intensity of a wavelength region shorter than 387 nm, namely of an energy higher than the band gap of anatase titania).

The contact angle of the orifice face 101 with ink is about 0°. Also the durability of superhydrophilicity of the above-mentioned film can be extended by mixing a hygroscopic substance such as $SiO_2$ (silica) in the superhydrophilic film 102.

The thickness of the superhydrophilic film 102 can be 5 $\mu$m or less, and preferably 2 $\mu$m or less. However, according the level of durability required for the liquid discharge head, the superhydrophilic film can be made thicker to about 5 to 10 $\mu$m, and such thickness allows to further improve the performance of the liquid discharge head.

Figure 4F:
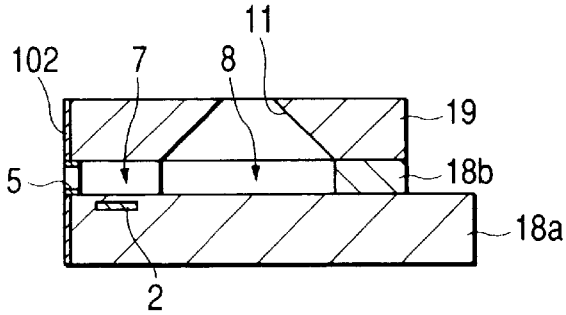

Thereafter the orifice portion is subjected to laser ablation working with an excimer laser under normal temperature and normal pressure. In this operation, an inversely tapered structure can be obtained by the power of the excimer laser. In this manner there can be obtained a liquid discharge head as shown in FIG. 4F.

Figure 5:
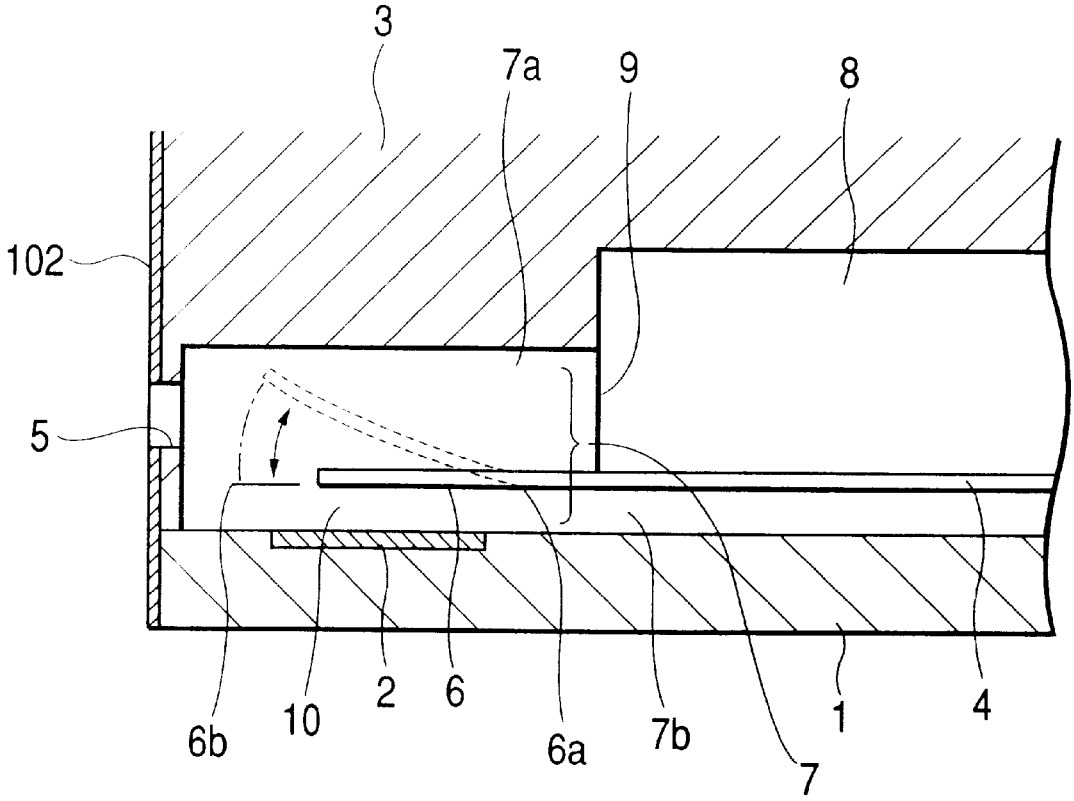
FIG. 5 is a schematic cross-sectional view of a liquid discharge head of the present invention along the direction of liquid flow path.
Figure 6:
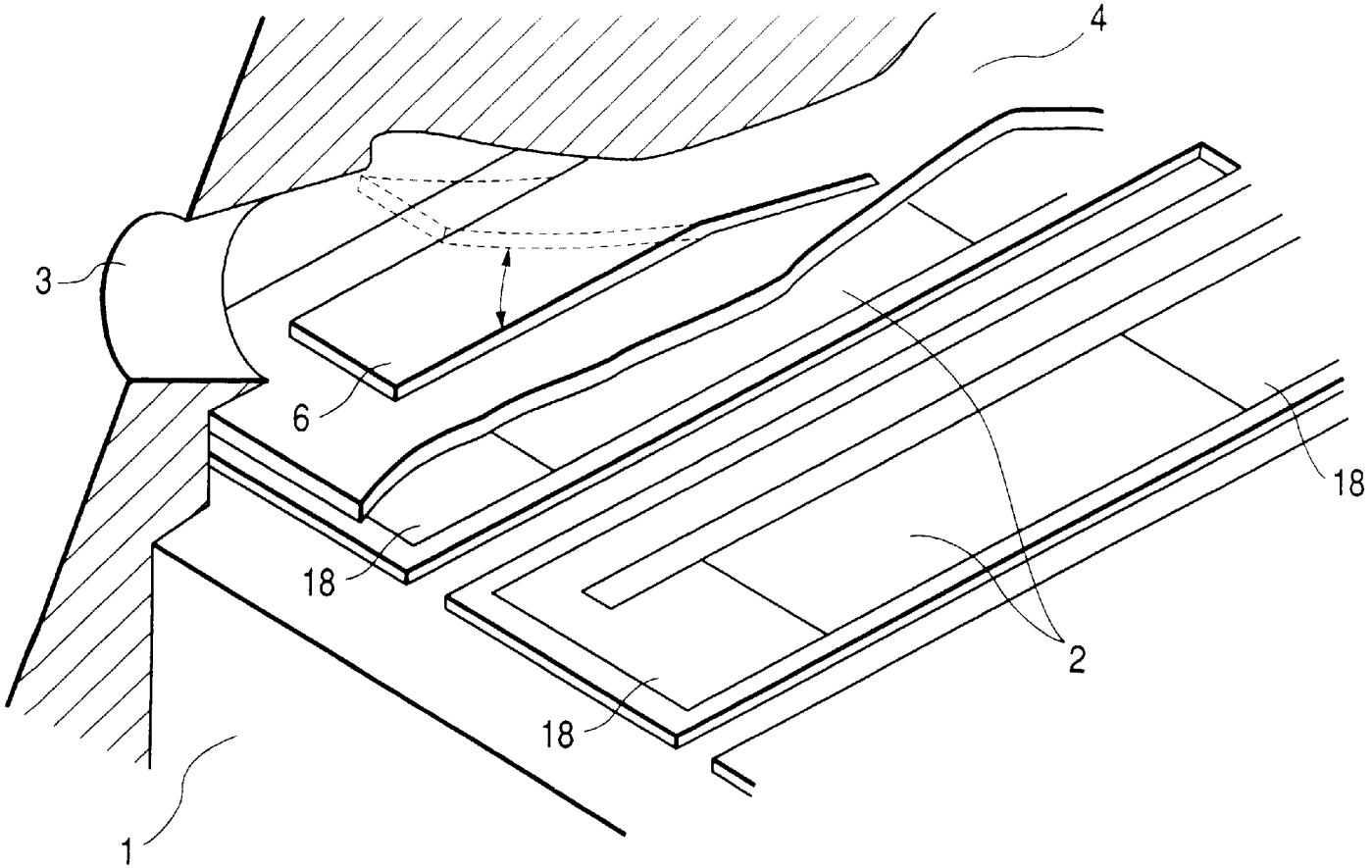
FIG. 6 is a partially broken perspective view of a liquid discharge head of the present invention along a liquid flow path thereof.
Figure 7:
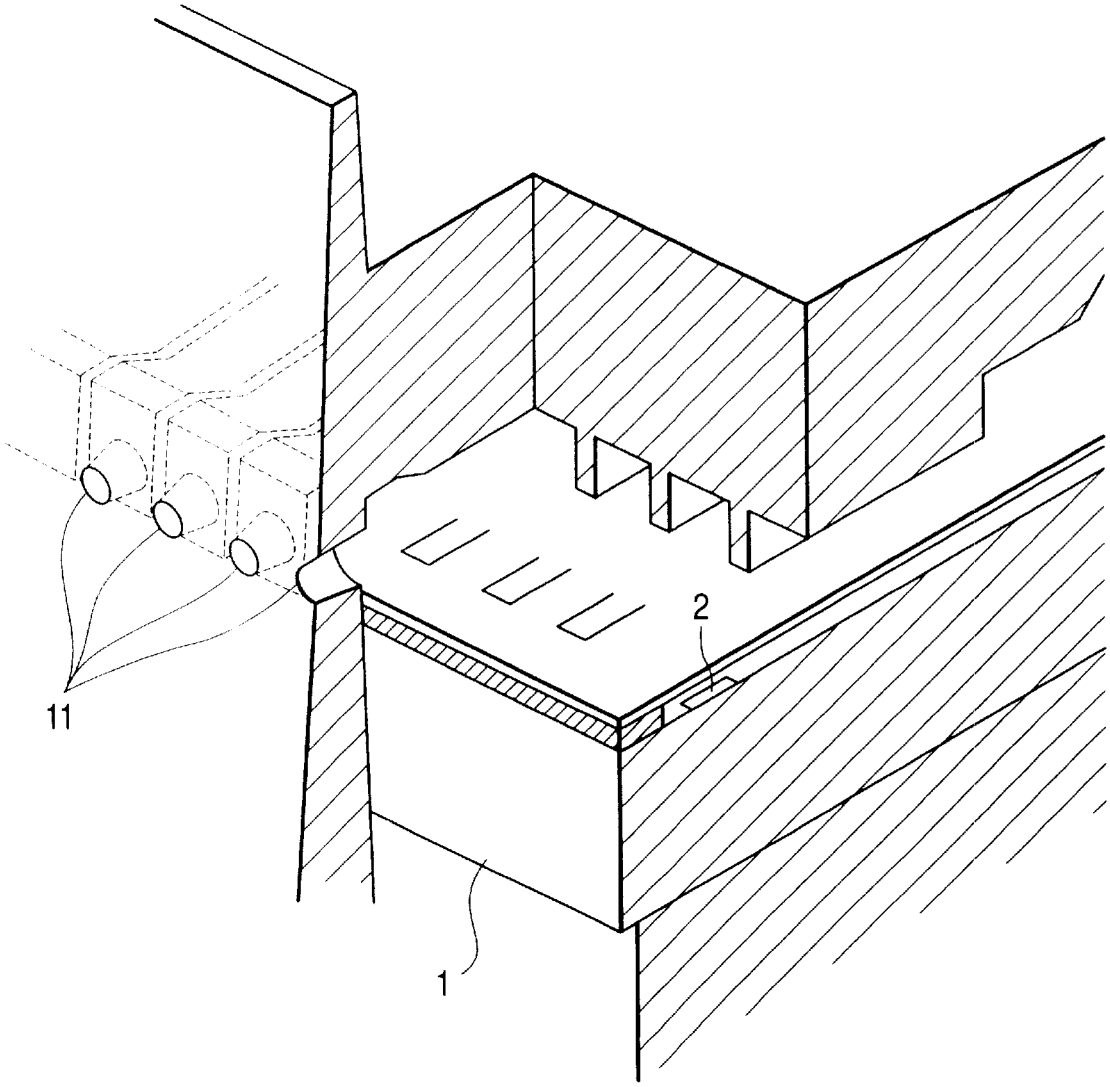
FIG. 7 is a perspective view showing a conventional configuration of the liquid discharge head.

FIG. 5 is a schematic cross-sectional view of a liquid discharge head of the present invention along the liquid flow path, and FIG. 6 is a partially broken perspective view of the liquid discharge head. The liquid discharge head of the present invention is provided, on a substrate 1 bearing a head generating element 2 for generating thermal energy for generating a bubble in the liquid, with a separating wall 4 composed of an elastic material such as an inorganic film, and such separating wall 4 repeats vertical vibration by the pressure of the bubble generated on the heat generating element 2.

In a space projected perpendicularly to the plane of the heat generating member, the separating wall is formed as a movable member 6 constructed as a beam supported at a fulcrum positioned at the side of the common liquid chamber, and the movable member 6 is so positioned as to be opposed to the bubble generating area (surface of the heat generating member 2).

Also in FIG. 6, on a substrate 1 bearing a heat generating element 2 constituting an electrothermal converting member and wiring electrode 18 for applying an electrical signal to the electrothermal converting member, a movable member 6 is provided in a space constituting a liquid flow path and in a form in contact with the substrate 1 by a fixing portion provided in the common liquid chamber. For forming the liquid discharge head, the two substrates are subsequently adjoined as explained in the foregoing and an anatase titania film of a thickness of 5 $\mu$m is formed on the orifice face 101.

Thereafter the orifice hole is formed by laser ablation with an excimer laser under normal temperature and normal pressure.

EXAMPLES

In the following the present invention will be clarified further by examples of the liquid discharge apparatus of the present invention, but the present invention is not limited to such examples.

Figure 8:
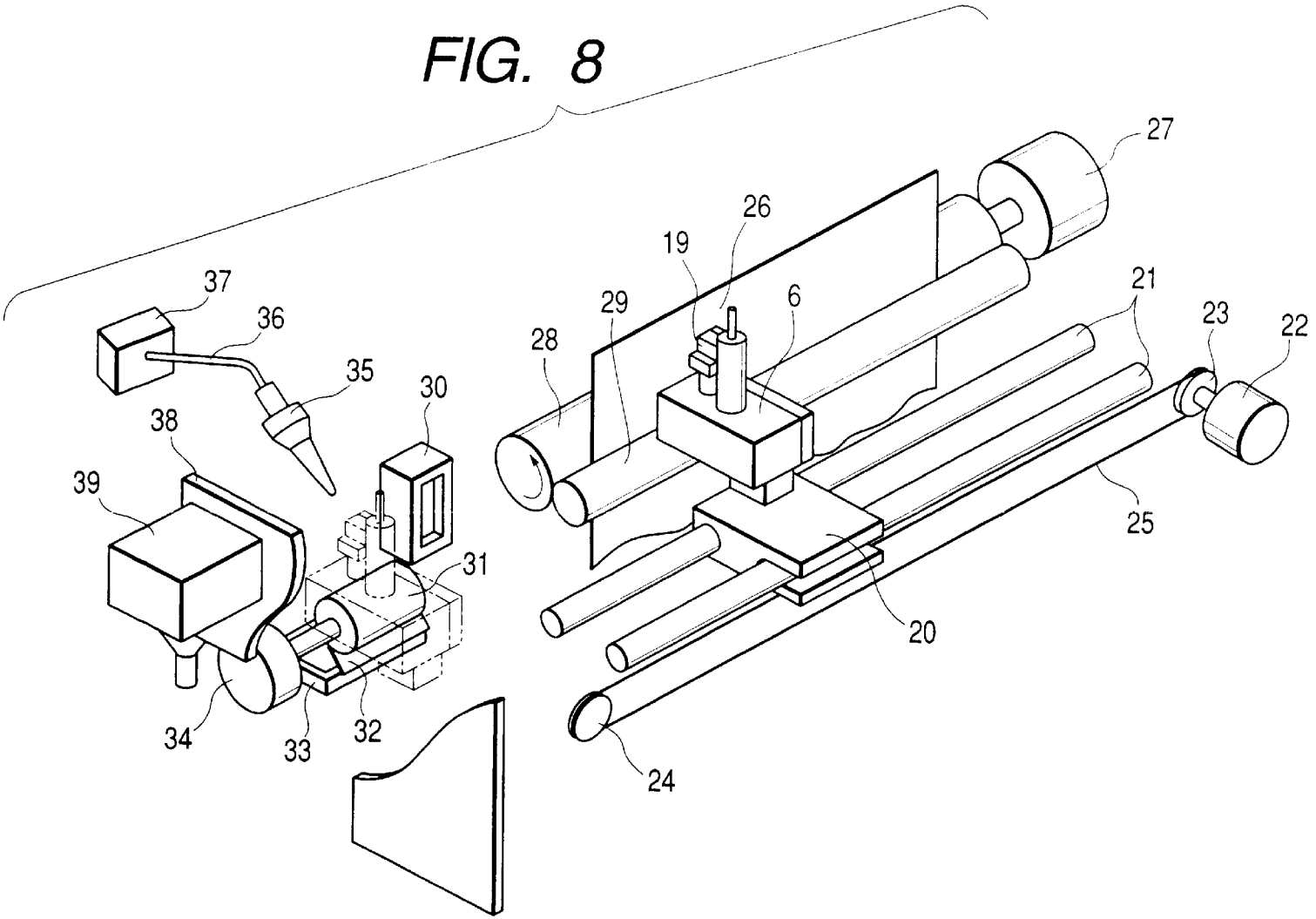
FIG. 8 is an exploded perspective view showing an example of the liquid discharge apparatus of the present invention.

FIG. 8 shows an example of the liquid discharge apparatus of the present invention, wherein a liquid discharge head 19 in which an orifice face 101 is coated with a superhydrophilic film 102 and is provided with plural nozzles, respectively including discharge heaters. In response to an input signal, the heater is energized thereby discharging the liquid by bubble generation. The above-mentioned head is fixed on a carriage 20. There are also shown a guide rail 21 for supporting and guiding the carriage 20, a motor 22 for driving the carriage, a pulley 23 directly connected to the motor 22, a driven pulley 24 opposed to the pulley 23, a wire 25 supported on the pulley 23 and the driven pulley 24 for transmitting the power of the motor 22 to the carriage 20, a recording medium 26 such as paper, a sheet feeding motor 27 connected to a sheet feeding roller 28 for moving the recording medium 26, and a pressure roller 29 for pressing the recording medium 26 to the roller 28 by unrepresented biasing means. A preparatory discharge receiving box 30 receives so-called idle discharge of ink droplets other than for recording by the liquid discharge head. A used ink roller 31 receives the ink discharged from the head 19, and is maintained in contact with a resin blade 32. A used ink receiver 33 receives the used ink. A motor 34 rotates the used ink roller 31, directly connected therewith, counterclockwise when seen from a direction opposite to the shaft. An air nozzle 35 serves to blow off the ink deposited on the orifice face of the liquid discharge head 19. The air nozzle 35 is connected through an air tube 36 to an air pump 37. An ink replenisher supporting frame 38 descends only in case of ink replenishment from the ink replenisher to an ink tank (not shown) connected to the liquid discharge head 19. The liquid discharge head 19 moves to a position vertically below an ink replenisher 39, and an end of an ink replenishing nozzle (not shown) provided in the lower part of the ink replenisher 39 presses open an openable plate (not shown) provided on the upper face of the ink tank of the liquid discharge head 19, and replenishes an appropriate amount of the ink.

Figure 9:
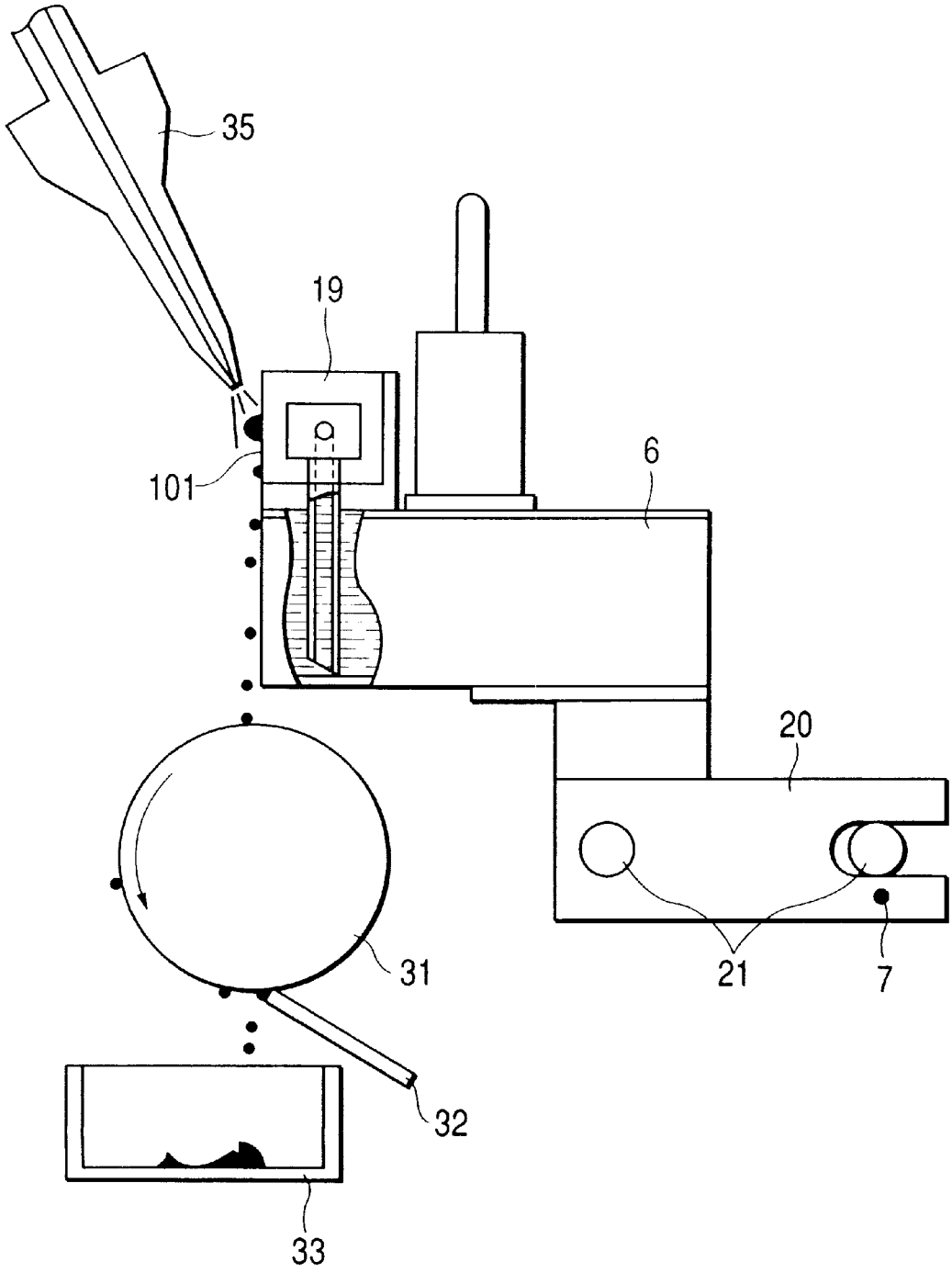
FIG. 9 is a schematic view showing a state of blowing off ink deposited on the orifice face.

FIG. 9 is a schematic view showing a state of blowing off the ink deposited on the orifice face. The ink is discharged from the orifice face 101 and a part of the ink is deposited on the orifice face 101. Then the air nozzle 35 blow air for 1 second whereby the deposited ink drops onto the surface of the used ink roller 31. The used ink roller 31 starts to rotate simultaneously with the air blowing from the air nozzle 35. The ink dropped onto the surface of the used ink roller immediately solidifies on the surface of the heated used ink roller, and the solidified ink is removed by the blade 32 and is discarded in the used ink receiver 33. The used ink roller stops after a turn. Then the carriage 20 moves to a recording start position detected by an unrepresented position sensor. Then the carriage executes a scanning motion parallel to the recording medium, and the liquid discharge head 19 discharges ink to execute recording.

The air nozzle 35 shown in FIGS. 8 and 9 may be provided with an unrepresented ultraviolet light source (with a wavelength not exceeding 387 nm). This light source serves to maintain the superhydrophilicity of the orifice face for a long period after the non-contact cleaning of the orifice face by the air nozzle is completed. Such ultraviolet light source may be provided within the apparatus, but it is also possible to introduce ultraviolet light from the exterior of the apparatus. For example, a mirror or the like may be provided in a recovery station shown in FIG. 9, in such a manner that the orifice face is exposed to the ultraviolet light from a fluorescent lamp in the room.

In a printing test with the above-described liquid discharge apparatus, the orifice face did not show smear deposition even after a prolonged operation and the satisfactory print quality could be maintained.

According to the present invention, as the orifice face is coated with a superhydrophilic film, there can be obtained a liquid discharge head capable of maintaining a satisfactory orifice state without smear deposition on the orifice face over a prolonged period.

Also for cleaning the liquid discharge head having the superhydrophilic film uniformly on the external surface, there is employed a non-contact cleaning method utilizing air or water (solution) to maintain the orifice face in stable manner for a prolonged period and also to extend the service life of the recovery system.

Such liquid discharge head and cleaning method allow to provide a liquid discharge apparatus capable of high speed recording of a high quality image in stable manner over a prolonged period.

What is claimed is:

1. A liquid discharge head provided with a substrate and a top plate mutually adjoined so as to form plural liquid flow paths, plural drive elements respectively formed in predetermined positions in said liquid flow paths, and orifices communicating respectively with ends of said liquid flow paths from which liquid is discharged by action of said drive elements, wherein a face constituting an external surface of a member forming said orifices is coated with a superhydrophilic material having mixed therein a hygroscopic material.

2. A liquid discharge head according to claim 1, wherein said drive element is a heat generating element for generating thermal energy, and said heat generating element causes the liquid in said liquid flow path to boil, thereby generating a bubble in said liquid and discharging said liquid from said orifice by a pressure generated at generation of said bubble.

3. A liquid discharge head according to claim 1, wherein the contact angle between said superhydrophilic material and the liquid does not exceed 5°.

4. A liquid discharge apparatus comprising a liquid discharge head according to any of claims 1 to 3.

5. A liquid discharge apparatus according to claim 4, further comprising an ultraviolet light source for maintaining a superhydrophilicity of said face over a long time period.

6. A liquid discharge apparatus according to claim 5, further comprising an aperture for introducing, from the exterior of the apparatus, ultraviolet light for maintaining a superhydrophilicity of said face over a long time period.

7. A liquid discharge apparatus according to claim 4, further comprising an aperture for introducing, from the exterior of the apparatus, ultraviolet light for maintaining a superhydrophilicity of said face over a long time period.

8. A liquid discharge apparatus comprising a liquid discharge head according to any of claims 1 to 3, and a cleaning member for removing liquid smear deposited on said face constituting the external surface of the member forming the orifices, without contacting said face.

9. A liquid discharge apparatus according to claim 8, further comprising an ultraviolet light source for maintaining a superhydrophilicity of said face over a long time period.

10. A liquid discharge apparatus according to claim 9, further comprising an aperture for introducing, from the exterior of the apparatus, ultraviolet light for maintaining a superhydrophilicity of said face over a long time period.

11. A liquid discharge apparatus according to claim 8, further comprising an aperture for introducing, from the exterior of the apparatus, ultraviolet light for maintaining a superhydrophilicity of said face over a long time period.

12. A liquid discharge head provided with a discharge port for discharging liquid, a liquid flow path communicating with said discharge port, a heat generating element provided in a predetermined position in said liquid flow path, and a supply aperture for supplying said liquid flow path with said liquid, in which said heat generating element causes the liquid in said liquid flow path to boil, thereby generating a bubble in said liquid and discharging said liquid from said discharge port by a pressure generated at generation of said bubble:

wherein a face constituting an external surface of a member forming said discharge port is coated with a superhydrophilic material having mixed therein a hygroscopic material.

13. A liquid discharge head according to claim 12, wherein the contact angle between said superhydrophilic material and said liquid does not exceed 5°.

14. A liquid discharge apparatus comprising a liquid discharge head according to claim 12.

15. A liquid discharge apparatus comprising a liquid discharge head according to claim 12, and a cleaning member for removing liquid smear deposited on said face constituting the external surface of the member forming said discharge port, without contacting said face.

16. A liquid discharge apparatus according to claim 14 or 15, further comprising an ultraviolet light source for maintaining a superhydrophilicity of said face over a long time period.

17. A liquid discharge apparatus according to claim 16, further comprising an aperture for introducing, from the exterior of the apparatus, ultraviolet light for maintaining a superhydrophilicity of said face over a long time period.

18. A liquid discharge apparatus according to any of claims 12 to 15, further comprising an aperture for introducing, from the exterior, ultraviolet light for maintaining the superhydrophilicity of said face over a long period.

19. A method for producing a liquid discharge head, comprising the steps of:

forming plural drive elements on a surface of a substrate;

adjoining the substrate and a top plate so as to obtain plural liquid flow paths corresponding respectively to the drive elements;

forming a member for forming orifices at an end of the adjoined substrate and top plate;

coating a face constituting an external surface of the member for forming orifices with a superhydrophilic material having mixed therein a hygroscopic material; and causing the orifices to respectively communicate with the liquid flow paths.

20. A method for producing a liquid discharge head, comprising the steps of:

forming an element substrate consisting of silicon;

forming plural heat generating elements for generating thermal energy on the element substrate;

adjoining the substrate and a top plate so as to obtain plural liquid flow paths corresponding respectively to the heat generating elements;

forming a member for forming orifices at an end of the adjoined substrate and top plate;

coating a face constituting an external surface of the member for forming orifices with a superhydrophilic material having mixed therein a hygroscopic material; and causing the orifices to respectively communicate with the liquid flow paths.

21. A method for producing a liquid discharge head comprising steps of:

forming a heat generating element for generating thermal energy on an element substrate consisting of silicon;

forming a liquid flow path corresponding to said heat generating element;

forming a supply aperture for supplying said liquid flow path with liquid;

forming a member for forming a discharge port for discharging said liquid;

coating said member with a superhydrophilic material having mixed therein a hygroscopic material; and forming a discharge port on said coated member.

* * * * *

UNITED STATES PATENT AND TRADEMARK OFFICE

CERTIFICATE OF CORRECTION

PATENT NO. : 6,540,330 B1
DATED : April 1, 2003
INVENTOR(S) : Masahiko Kubota et al.

It is certified that error appears in the above-identified patent and that said Letters Patent is hereby corrected as shown below:

Title page,
Item [56], References Cited, OTHER PUBLICATIONS, "63-092455" should read -- 63-092459 --.

Column 4,
Line 30, "al," should read -- Al, --; and
Line 49, "will" should read -- well --.

Column 6,
Line 67, "subjected" should read -- subjected to --.

Column 8,
Line 55, "blow" should read -- blows --.

Signed and Sealed this

Twenty-eighth Day of October, 2003

JAMES E. ROGAN
*Director of the United States Patent and Trademark Office*